US009631421B2

(12) United States Patent
Cheng

(10) Patent No.: US 9,631,421 B2
(45) Date of Patent: Apr. 25, 2017

(54) LIGHT INPUT-ADJUSTABLE WINDOW SHADE

(71) Applicant: Li-Ming Cheng, Kaohsiung (TW)

(72) Inventor: Li-Ming Cheng, Kaohsiung (TW)

( * ) Notice: Subject to any disclaimer, the term of this patent is extended or adjusted under 35 U.S.C. 154(b) by 94 days.

(21) Appl. No.: 14/536,750

(22) Filed: Nov. 10, 2014

(65) Prior Publication Data

US 2016/0130869 A1 May 12, 2016

(51) Int. Cl.

| | |
|---|---|
| ***A47G 5/02*** | (2006.01) |
| ***A47H 1/00*** | (2006.01) |
| ***E06B 9/40*** | (2006.01) |
| ***E06B 9/42*** | (2006.01) |
| *E06B 9/24* | (2006.01) |

(52) U.S. Cl.

CPC ..... *E06B 9/40* (2013.01); *E06B 9/42* (2013.01); *E06B 2009/2405* (2013.01)

(58) Field of Classification Search

CPC ..... E06B 9/40; E06B 2009/407; E06B 9/42; E06B 2009/402; E06B 2009/2405

USPC ..... 160/21, 39, 240, 263

See application file for complete search history.

(56) References Cited

U.S. PATENT DOCUMENTS

| | | | | |
|---|---|---|---|---|
| 2,350,235 A * | 5/1944 | Johnson | E06B 9/42 160/387 |
| 3,372,728 A * | 3/1968 | Schaefer | A47H 2/02 160/39 |
| 7,267,156 B2 * | 9/2007 | Byeon | E06B 9/40 160/121.1 |
| 8,646,509 B2 | 2/2014 | Chu | |
| 2015/0151425 A1 * | 6/2015 | Bonini | E06B 9/42 160/120 |

FOREIGN PATENT DOCUMENTS

JP 07189573 A 7/1998

* cited by examiner

*Primary Examiner* — Katherine Mitchell
*Assistant Examiner* — Jeremy Ramsey
(74) *Attorney, Agent, or Firm* — Alan D. Kamrath; Kamrath IP Lawfirm, P.A.

(57) ABSTRACT

A light input-adjustable window shade includes a supporting unit having a main rod and two sliding rods. Each sliding rod is slideably mounted to one of two ends of the main rod. A positioning seat is fixed to an end of each sliding rod distant to the main rod. Each sliding rod has a coupling portion. A spool is rotatably mounted to the positioning seats of the supporting unit. A shade body includes a first periphery fixed to the spool and a second periphery. The shade body is coiled around the spool. A weighting unit includes a rod body formed by an inner rod and two movable rods. Each movable rod is slideably mounted to one of two ends of the inner rod. The shade body is wound around the rod body. The second periphery of the shade body is fixed to the coupling portions of the two sliding rods.

18 Claims, 6 Drawing Sheets

LIGHT INPUT-ADJUSTABLE WINDOW SHADE

BACKGROUND OF THE INVENTION

1. Field of the Invention

The present invention relates to a light input-adjustable window shade and, more particularly, to a light input-adjustable window shade that is adjustable for installation on spools and shade bodies of different lengths.

2. Description of the Related Art

A type of light input-adjustable window shade includes a supporting rod, a blind sheet or a shade body, and a weighting rod. The supporting rod is mounted to a top of a door or a window. An end of the shade body is fixed and wound around the supporting rod. The other end of the shade body is wound around the weighting rod and is coupled to the supporting rod. Thus, the shade body is folded relative to the weighting rod to form a dual-layer shade body structure permitting adjustment of the light input amount. An example of such a light input-adjustable window shade is disclosed in Japanese Patent Publication No. 1995-189573 and U.S. Pat. No. 7,267,156.

However, doors and windows have different sizes such that the user may have to purchase a light input-adjustable window shade of a corresponding size. To provide light input-adjustable window shades of different sizes, manufacturers have to provide supporting rods and weighting rods of different specifications for shade bodies of different sizes. Otherwise, the supporting rod or the weighting rod could be too long or too short for the shade body.

Accordingly, manufacturers must produce molds for production of supporting rods and weighting rods of different specifications for the purposes of providing light input-adjustable window shades of various sizes to be purchased by consumers, which greatly increase the production costs of the light input-adjustable window shades. Thus, a need exists for an improved light input-adjustable window shade to reduce the production costs for light input-adjustable window shades of various sizes and, hence, increase the market value of the light input-adjustable window shades.

SUMMARY OF THE INVENTION

An objective of the present invention is to provide a light input-adjustable window shade including a supporting unit and a weighting unit for installation with spools and shade bodies of different lengths, reducing the production costs of the light input-adjustable window shade.

The present invention fulfills the above objective by providing a light input-adjustable window shade including a supporting unit having a main rod and two sliding rods. Each of the two sliding rods is slideably mounted to one of two ends of the main rod. A positioning seat is fixed to an end of each of the two sliding rods distant to the main rod. Each of the two sliding rods has a coupling portion. A spool is rotatably mounted to the positioning seats of the supporting unit. A shade body includes a first periphery fixed to the spool and a second periphery. The first periphery of the shade body is coiled around the spool. A weighting unit includes a rod body comprised of an inner rod and two movable rods. Each of the two movable rods is slideably mounted to one of two ends of the inner rod. The shade body is wound around the rod body. The second periphery of the shade body is fixed to the coupling portions of the two sliding rods.

Each positioning seat can include a positioning section and a pivotal section. The positioning section of each positioning seat is coupled to the end of one of the two sliding rods distant to the main rod. The spool includes two ends respectively and is pivotably connected to the pivotal sections of the positioning seats.

The pivotal section of each positioning seat can be a pivot. Each of the two ends of the spool can include a receptacle. The receptacles of the spool pivotably engage with the pivotal sections of the positioning seats.

Each of the two sliding rods can include a first channel having an opening facing the main rod. The first channels of the two sliding rods respectively receive the two ends of the main rod.

The supporting unit can further include a sleeve having two ends and a second channel extending through the two ends of the sleeve. The sleeve is mounted around the two sliding rods. The second channel slideably receives the two sliding rods.

The sleeve can further include a slit intercommunicated with the second channel. The slit overlaps with the coupling portions of the two sliding rods in an extending direction of the main rod.

The main rod can further include a sixth channel extending through the two ends of the main rod. The two sliding rods respectively slideably extend through two ends of the sixth channel.

The main rod can further include a slit intercommunicated with the sixth channel. The slit overlaps with the coupling portions of the two sliding rods in the extending direction of the main rod.

Each of the two movable rods of the rod body can further include a third channel having an opening facing the inner rod of the rod body. The third channels of the two movable rods respectively receive the two ends of the inner rod.

The weighting unit can further include an adjusting member comprised of a main beam and two sliding beams. The two sliding beams are respectively slideably received in two ends of the main beam.

The main beam of the adjusting member can further include a fourth channel extending through the two ends of the main beam. The two sliding beams of the adjusting member respectively slideably extend through two ends of the fourth channel.

The rod body can be received in the adjustment member. Each of the two sliding beams of the adjusting member can include a fifth channel extending through the two ends of the sliding beam. The fifth channels of the two sliding beams intercommunicate with the fourth channel of the main beam. The rod body is received in the fourth channel of the main beam and the fifth channels of the two sliding beams.

The main beam can further include a first opening intercommunicated with the fourth channel. The first opening extends through the two ends of the main beam. Each of the two sliding beams can further include a second opening intercommunicated with the fifth channel thereof Each second opening extends through the two ends of the one of the two sliding beams. The first opening of the main beam overlaps with the second openings of the two sliding beams in an extending direction of the main beam.

The second periphery of the shade body extends through the first opening of the main beam and the second openings of the two sliding beams of the adjusting member and extends into the fourth channel of the main beam and the fifth channels of the two sliding beams. The shade body is wound around the rod body and extends out of the weighting unit via the first opening of the main beam and the second openings of the two sliding beams. The second periphery of the shade body is fixed to the coupling portions of the two sliding rods.

The weighting unit can further include two fixing members respectively on two ends thereof. Each of the two fixing members includes a first fixing portion and a second fixing portion. Two ends of the rod body are respectively coupled to the first fixing portions of the two fixing members. Two ends of the adjusting member are coupled to the second fixing portions of the two fixing members.

The shade body can include a plurality of light-impermeable portions and a plurality of light-permeable portions. Each of the plurality of light-impermeable portions is located between two adjacent light-permeable portions.

By provision of the light input-adjustable window shade, the two sliding rods of the supporting unit are slideably mounted to the two ends of the main rod such that the length of the supporting unit can be adjusted. Furthermore, the weighting unit includes a length-adjustable rod body and a length-adjustable adjusting member such that the length of the weighting unit can be adjusted. Thus, the light input-adjustable window shade according to the present invention can be installed with spools and shade bodies of different lengths without the need of replacing the supporting unit and the weighting unit while avoiding excessive length or insufficient length of the supporting unit or the weighting unit relative to the shade body. The production costs of the light input-adjustable window shade are, thus, reduced.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

DETAILED DESCRIPTION OF THE INVENTION

The term "light input-adjustable window shade" referred to hereinafter means a dual-layer window shade, such as a rainbow curtain or an accordion curtain, which can be coiled to provide a light shielding effect while the dual-layer window shade permits adjustment of the light input amount, which can be appreciated by one having ordinary skill in the art.

Figure 1:
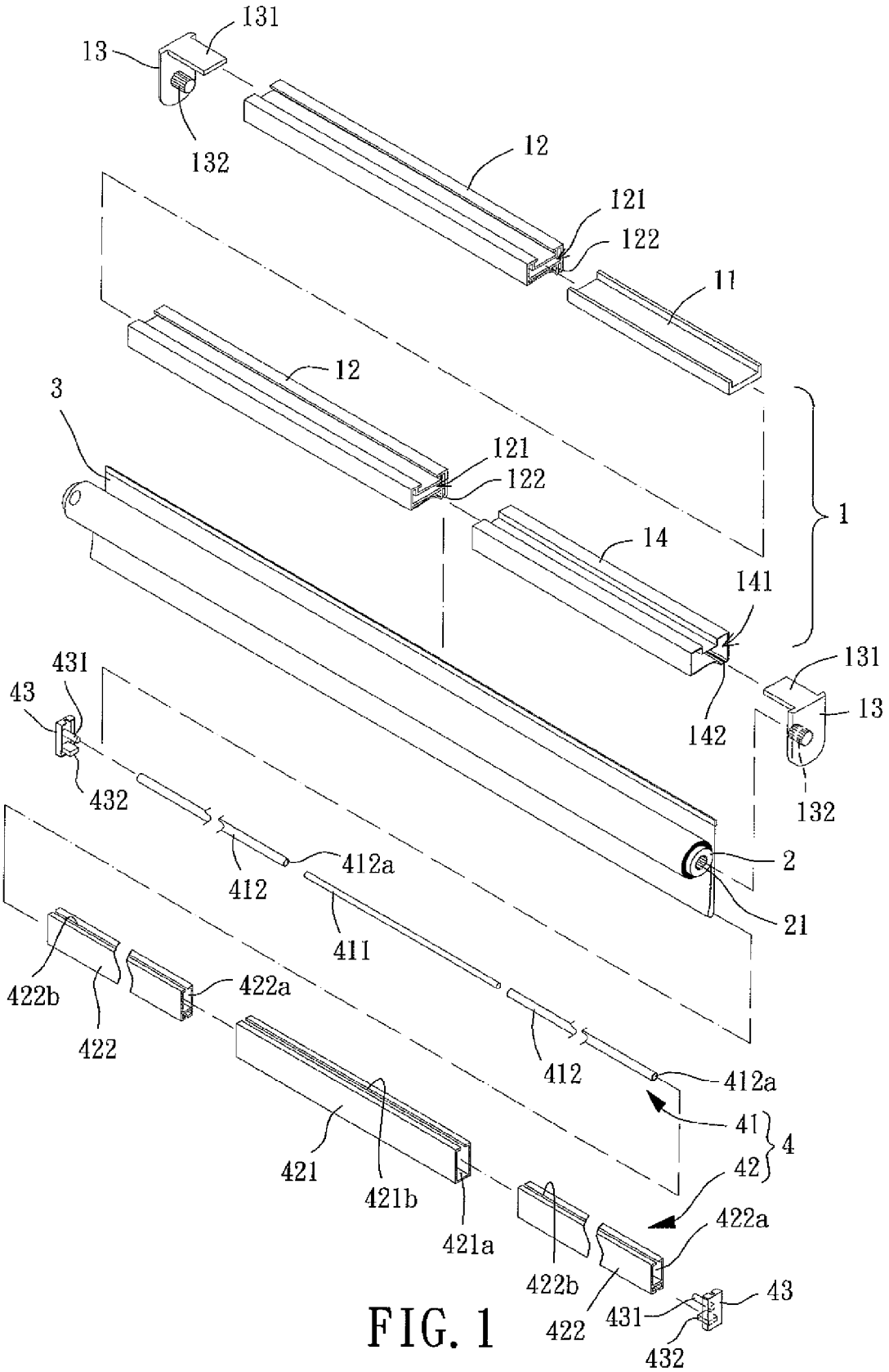
FIG. 1 is an exploded, perspective view of a light input-adjustable window shade of an embodiment according to the present invention.
Figure 2:
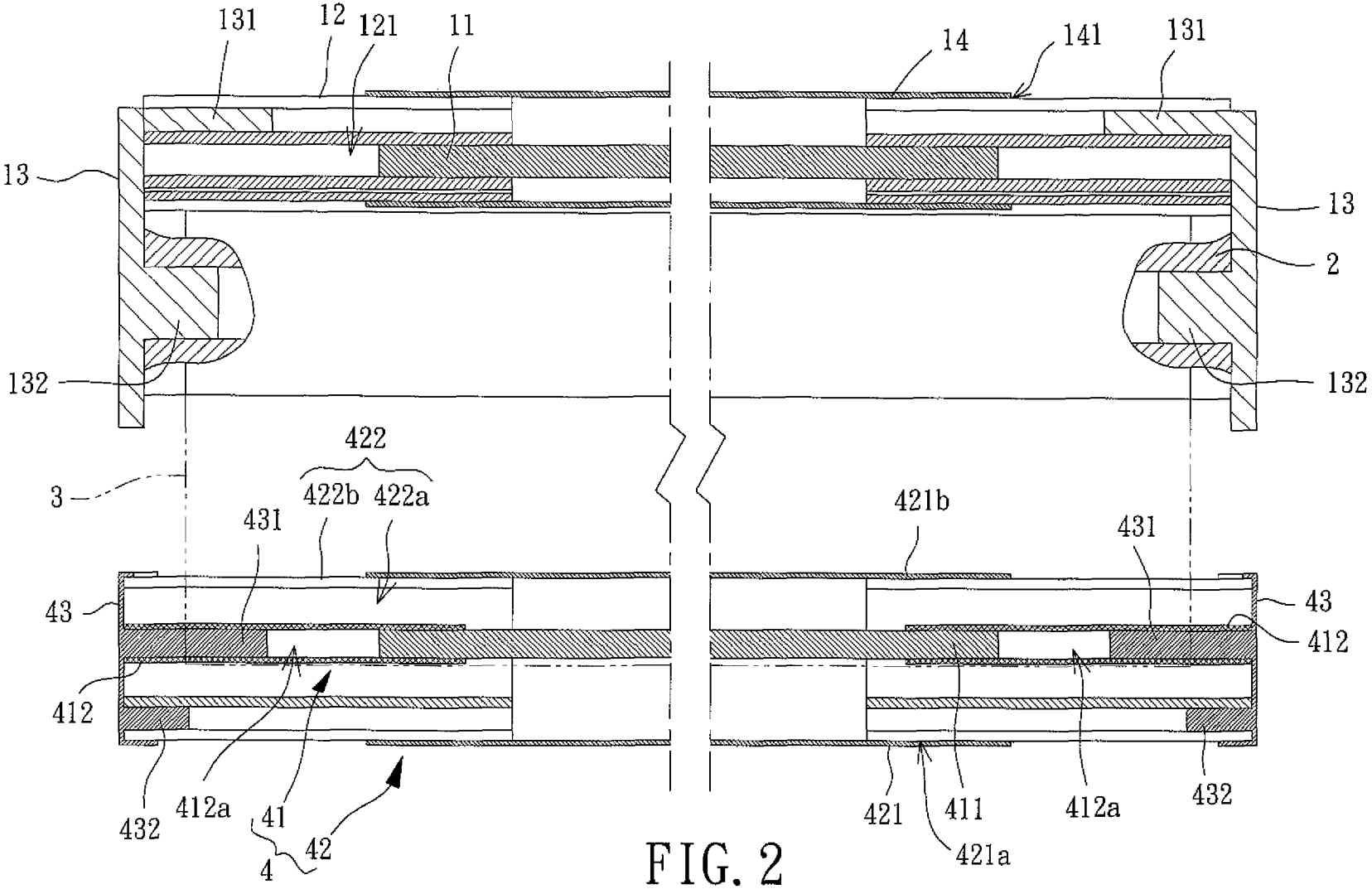
FIG. 2 is a longitudinal cross sectional view of the light input-adjustable window shade of FIG. 1 taken along a longitudinal direction of the light input-adjustable window shade.
Figure 3:
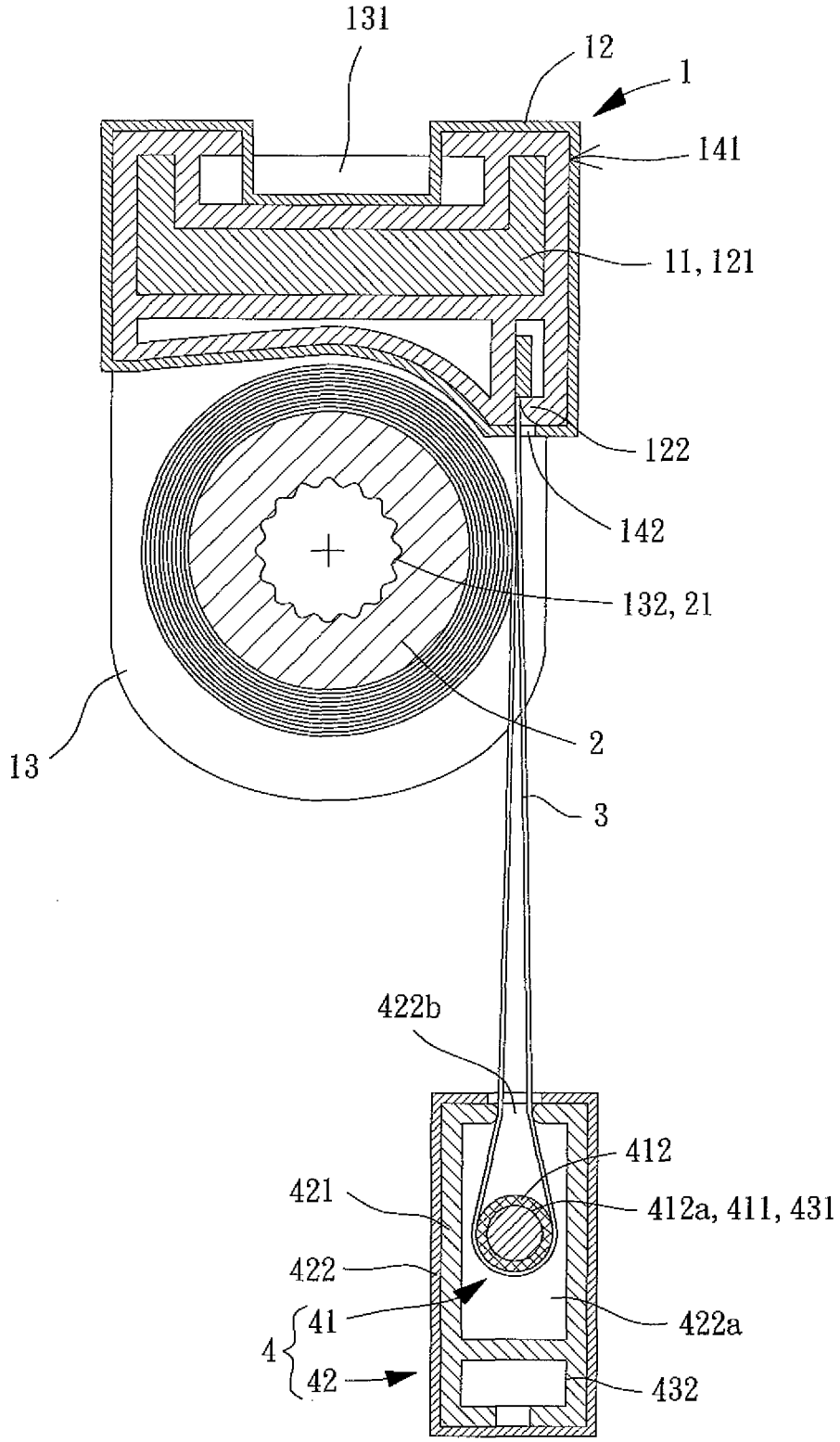
FIG. 3 is another cross sectional view of the light input-adjustable window shade of FIG. 1 taken along a direction perpendicular to the longitudinal direction.

With reference to FIGS. 1-3, a light input-adjustable window shade of an embodiment according to the present invention includes a supporting unit 1, a spool 2, a shade body 3, and a weighting unit 4. The spool 2 is rotatably mounted to the supporting unit 1. The weighting unit 4 includes a rod body 41. A first periphery of the shade body 3 is fixed to the spool 2. The shade body 3 is coiled around the spool 2 and is wound around the rod body 41 of the weighting unit 4. A second periphery of the shade body 3 is fixed to the supporting unit 1.

The supporting unit 1 includes a main rod 11 and two sliding rods 12. Each sliding rod 12 is slideably mounted to one of two ends of the main rod 11. Specifically, in this embodiment, each sliding rod 12 includes a first channel 121 having an opening facing the main rod 11. The first channels 121 of the sliding rods 12 respectively receive the two ends of the main rod 11 such that sliding rods 12 can slide in an extending direction of the main rod 11. By adjusting the positions of the sliding rods 12 relative to the main rod 11 to adjust the spacing between the sliding rods 12, the length of the supporting unit 1 can be adjusted. A positioning seat 13 is fixed to an end of each sliding rod 12 distant to the main rod 11, such that two ends of the supporting unit 1 are respectively coupled to the positioning seats 13. Each positioning seat 13 includes a positioning section 131 and a pivotal section 132. The positioning section 131 of each positioning seat 13 can be any fixing structure (such as a mortise, a tenon, or a hook) and is coupled to the end of one of the sliding rods 12 distant to the main rod 11. Each sliding rod 12 has a coupling portion 122 for coupling with the shade body 3.

The supporting unit 1 can further include a sleeve 14 having a second channel 141 extending through two ends of the sleeve 14. The sleeve 14 is mounted around the two sliding rods 12 by the second channel 141. The second channel 141 slideably receives the two sliding rods 12. When the sliding rods 12 slide in the extending direction of the main rod 11, an intersection between each sliding rod 12 and the main rod 11 is not exposed. The sleeve 14 further includes a slit 142 intercommunicated with the second channel 141. The slit 142 overlaps with the coupling portions 122 of the two sliding rods 12 in the extending direction of the main rod 11. Thus, the coupling portion 122 of each sliding rod 12 extends through the slit 142 of the shade body 3.

The spool 2 includes two ends respectively pivotably connected to the pivotal sections 132 of the positioning seats 13. By coupling the two ends of the supporting unit 1 with the positioning seats 13, the spool 2 is rotatably mounted to the positioning seats 13 of the supporting unit 1. The pivotal section 132 of each positioning seat 13 can be a pivot or a bearing such that the two ends of the spool 2 can respectively pivotably couple with the pivotal sections 132 of the positioning seats 13. In this embodiment, the pivotal section 132 of each positioning seat 13 is a pivot, and each of the two ends of the spool 2 includes a receptacle 21. The receptacles 21 of the spool 2 are pivotably engaged with the pivotal sections 132 of the positioning seats 13. Preferably, the pivotal section 132 of each positioning seat 13 is located between the positioning section 131 and the weighting unit 4. Thus, the spool 2 is located between the supporting unit 1 and the weighting unit 4 after the spool 2 has been rotatably mounted to the supporting unit 1. The first periphery of the shade body 3 is fixed to the spool 2. The shade body 3 is coiled around the spool 2. The second periphery of the shade body 3 is fixed to the coupling portions 122 of the sliding rods 12 of the supporting unit 1 after having been wound around the rod body 41 of the weighting unit 4.

The weighting unit 4 includes a length-adjustable rod body 41. Preferably, the weighting unit 4 includes a length-adjustable adjusting member 42 cooperating with the rod body 41. By synchronously adjusting the lengths of the rod body 41 and the adjusting member 42, the length of the weighting unit 4 can be adjusted. Specifically, the weighting unit 4 includes two fixing members 43 respectively on two ends thereof. Each fixing member 43 includes a first fixing portion 431 and a second fixing portion 432. The two ends of the rod body 41 are respectively coupled to the first fixing portions 431 of the fixing members 43. Two ends of the adjusting member 42 are coupled to the second fixing portions 432 of the two fixing members 43. Thus, the rod body 41 and the adjusting member 42 are mounted between the two fixing members 43 such that the length of the rod body 41 can synchronously be adjusted when the length of the adjusting member 42 is adjusted. Since the shade body 3 is wound around the rod body 41 and then fixed to the supporting unit 1, the rod body 41 is wrapped by the shade body 3. The adjusting member 42 is exposed to permit adjustment of the length of the weighting unit 4. Furthermore, the shade body 3 can be pulled downwards by the weight of the rod body 41 and the adjusting member 42 to thereby stretch and support the shade body 3.

The rod body 41 is comprised of an inner rod 411 and two movable rods 412. Each movable rod 412 is slideably mounted to one of two ends of the inner rod 411. In this embodiment, each movable rod 412 is in the form of a tube. Each movable rod 412 includes a third channel 412*a* having an opening facing the inner rod 411. The third channels 412*a* of the two movable rods 412 respectively receive the two ends of the inner rod 41. Thus, the two movable rods 412 can slide in an extending direction of the inner rod 411 to change the spacing between the two movable rods 412 for the purposes of adjusting the length of the rod body 41. One of the two ends of each movable rod 412 distant to the inner rod 412 is fixed to the first fixing portion 431 of one of the fixing members 43.

The adjusting member 42 is comprised of a main beam 421 and two sliding beams 422. The two sliding beams 422 are respectively and slideably received in two ends of the main beam 421. In this embodiment, the main beam 421 of the adjusting member 42 includes a fourth channel 421*a* extending through the two ends of the main beam 421. The two sliding beams 422 of the adjusting member 42 respectively slideably extend through two ends of the fourth channel 421 *a*. Thus, the two sliding beams 422 can slide in an extending direction of the main beam 421 to change the spacing between the two sliding beams 422 to thereby adjust the length of the adjusting member 42. One of the two ends of each sliding beam 422 distant to the main beam 421 is fixed to the second fixing portion 432 of one of the fixing members 43.

In this embodiment, the rod boy 41 is mounted in the adjusting member 42. Specifically, each sliding beam 422 of the adjusting member 42 includes a fifth channel 422*a* extending through the two ends of the sliding beam 422. The fifth channels 422*a* of the two sliding beams 422 intercommunicate with the fourth channel 421*a* of the main beam 421. The rod body 41 is received in the fourth channel 421*a* of the main beam 421 and the fifth channels 422*a* of the two sliding beams 422. Thus, the rod body 41 is received in the adjusting member 42.

The main beam 421 further includes a first opening 421*b* intercommunicated with the fourth channel 421 a. The first opening 421*b* extends through the two ends of the main beam 421. Each sliding beam 422 further includes a second opening 422*b* intercommunicated with the fifth channel 422*a* of the sliding beam 422 and extending through the two ends of the sliding beam 422. The first opening 421*b* of the main beam 421 overlaps with the second openings 422*b* of the two sliding beams 422 in the extending direction of the main beam 421.

By such an arrangement, with reference to FIG. 3, the second periphery of the shade body 3 extends through the first opening 421 of the main beam 421 and the second openings 422*b* of the two sliding beams 422 of the adjusting member 42 and extends into the fourth channel 421*a* of the main beam 421 and the fifth channels 422*a* of the two sliding beams 422. Then, the second periphery of the shade body 3 is wound around the rod body 41, extends out of the weighting unit 4 via the first opening 421 and the second openings 422*b* , and is fixed to the coupling portions 122 of the two sliding rods 12 of the supporting unit 1.

By the above structure, in use of the light input-adjustable window shade according to the present invention, the length of the supporting unit 1 can be adjusted by adjusting the relative positions between the two sliding rods 12 and the main rod 11 of the supporting unit 1, such that the combined length of the two sliding rods 12 and the main rod 11 corresponds to the length of the spool 2 and the shade body 3. At the same time, the length of the rod body 41 and the adjusting member 42 of the weighting unit 4 can be adjusted such that the length of the weighting unit 4 corresponds to the length of the shade body 3. Thus, the spool 2 can be accurately mounted between the positioning seats 13 of the supporting unit 1. The shade body 3 can be wound around the rod body 41 of the weighting unit 4 and can be fixed to the coupling portions 122 of the two sliding rods 12 of the supporting unit 1, avoiding excessive length or insufficient length of the supporting unit 1 or the weighting unit 4 relative to the shade body 3.

Figure 4:
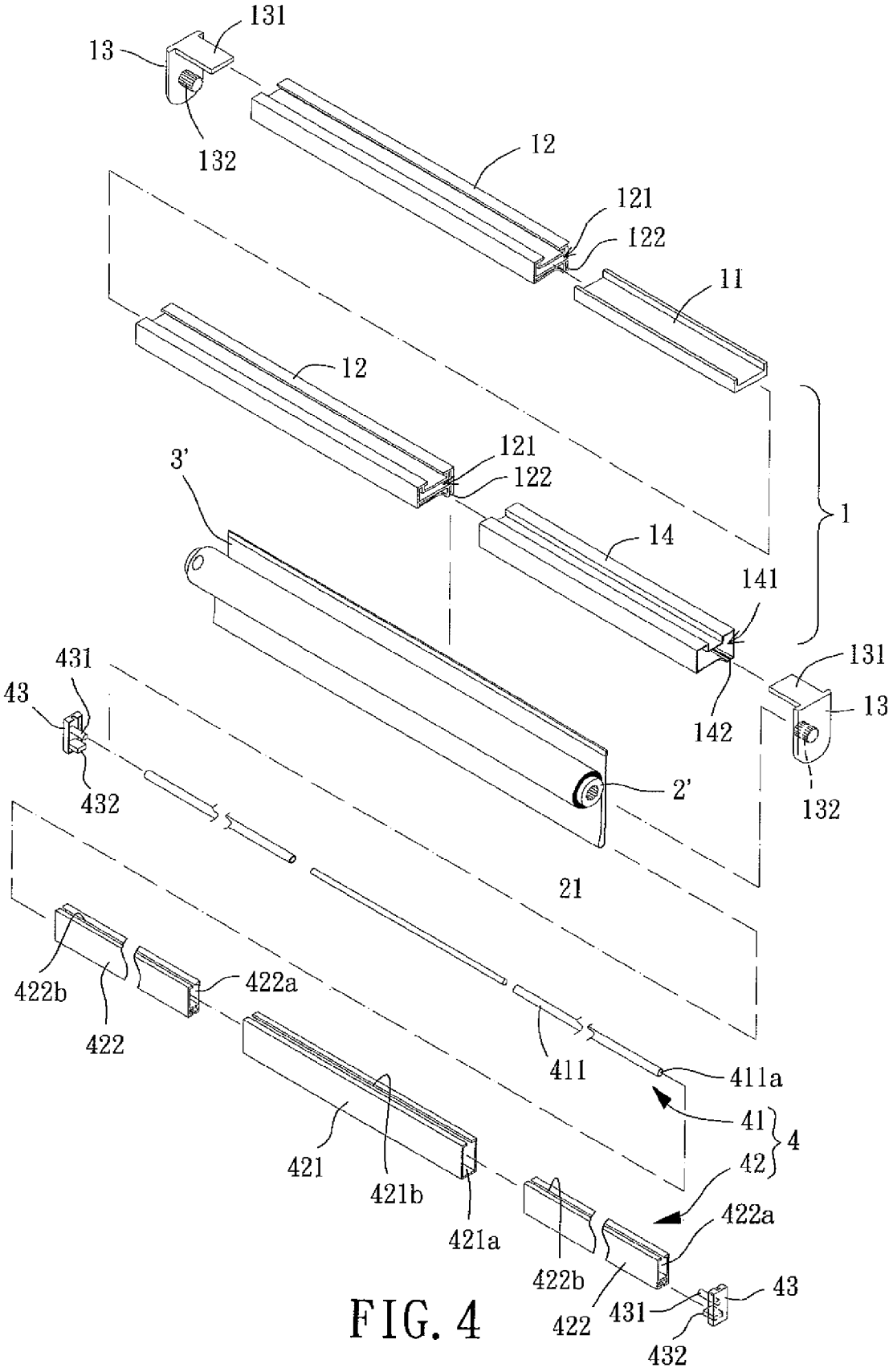
FIG. 4 is an exploded, perspective view of a light input-adjustable window shade with a shorter shade body of an embodiment according to the present invention.
Figure 5:
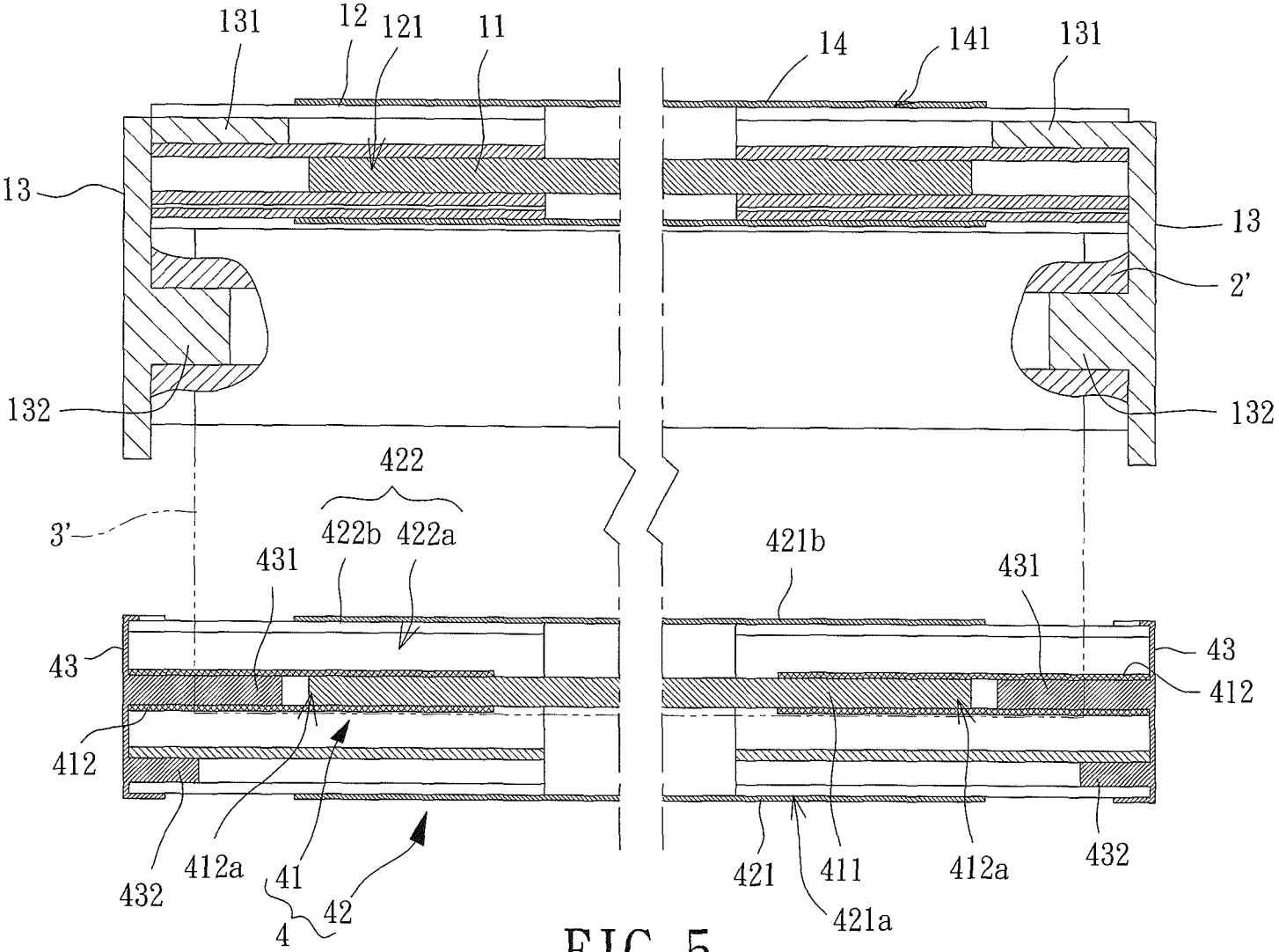
FIG. 5 is a longitudinal cross sectional view of the light input-adjustable window shade of FIG. 4.

FIGS. 4 and 5 show a light input-adjustable window shade according to the present invention having a shorter shade body 3'. A shorter spool 2' can be used to match the length of the shade body 3'. The length of the supporting unit 1 is adjusted by adjusting the relative positions between the two sliding rods 12 and the main rod 11 of the supporting unit 1, such that the combined length of the two sliding rods 12 and the main rod 11 corresponds to the length of the spool 2' and the shade body 3'. At the same time, the length of the rod body 41 and the adjusting member 42 of the weighting unit 4 is adjusted such that the length of the weighting unit 4 corresponds to the length of the shade body 3'. Thus, the spool 2' can be accurately mounted between the positioning seats 13 of the supporting unit 1 while avoiding excessive length or insufficient length of the supporting unit 1 or the weighting unit 4 relative to the shade body 3'. Namely, the light input-adjustable window shade according to the present invention can be installed with spools 2 and 2' and shade bodies 3 and 3' of different lengths without the need of replacing the supporting unit 1 and the weighting unit 4 while avoiding excessive length or insufficient length of the supporting unit 1 or the weighting unit 4 relative to the shade body 3, 3'.

Figure 6:
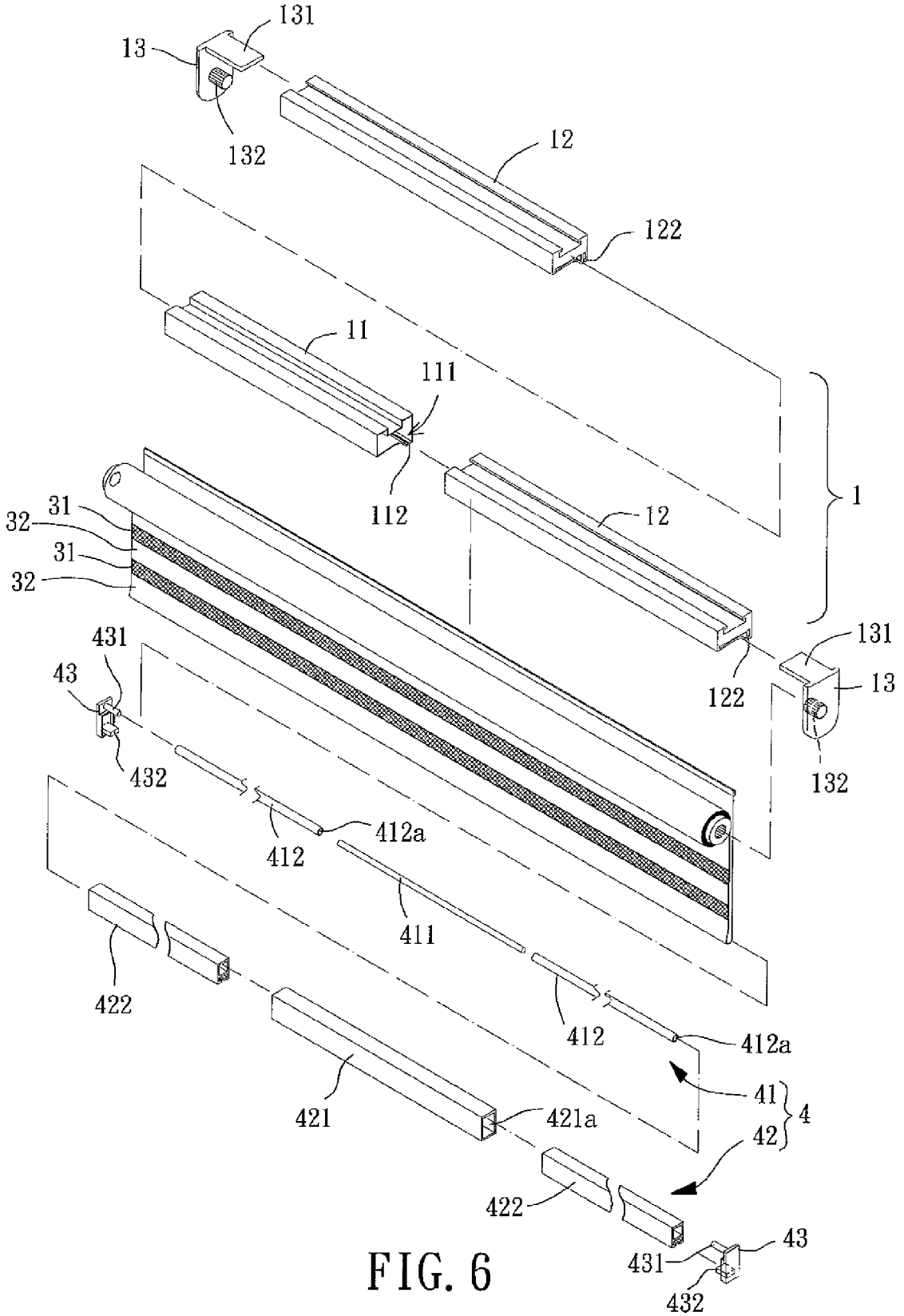
FIG. 6 is an exploded, perspective view of a light input-adjustable window shade of another embodiment according to the present invention.

FIG. 6 shows a light input-adjustable window shade of another embodiment according to the present invention. In this embodiment, the light input-adjustable window shade also includes a supporting unit 1, a spool 2, a shade body 3, and a weighting unit 4. The two sliding rods 12 of the supporting unit 1 are slideably mounted to two ends of the main rod 11. The differences between this embodiment and the above embodiments are that the main rod 11 includes a sixth channel 111 extending through the two ends of the main rod 11, and the two sliding rods 12 respectively slideably extend through two ends of the sixth channel 111. Thus, the two sliding rods 12 can slide in the extending direction of the main rod 11. The main rod 11 further includes a slit 112 intercommunicated with the sixth channel 111. The slit 112 overlaps with the coupling portions 122 of the two sliding rods 12 in the extending direction of the main rod 11. Thus, the coupling portion 122 of each sliding rod 12 extends through the slit 112 of the main rod 11.

As can be seen from the above, in the light input-adjustable window shade of each embodiment according to the present invention, the two sliding rods 12 of the supporting unit 1 are slideably mounted to the two ends of the main rod 11. Each sliding rod 12 includes a first channel 121 for receiving one of the two ends of the main rod 11. Alternatively, the main rod 11 can include a sixth channel 111 for receiving the two sliding rods 12. The present invention is not limited to the forms shown. Likewise, the movable rod 412 of the rod body 41 of the weighting unit 4 includes a third channel 412*a* for receiving the two ends of the inner rod 411. Alternatively, the inner rod 411 can include a channel for receiving the two movable rods 412. Furthermore, the sliding beams 422 of the adjusting member 42 of the weighting unit 4 includes fifth channels 422*a* for receiving the two ends of the main beam 421. Alternatively, the main beam 421 can include a channel for receiving the two sliding beams 422. These modifications can easily be appreciated by one skilled in the art.

Still referring to FIG. 6, the shade body 3 can include a plurality of light-impermeable portions 31 and a plurality of light-permeable portions 32. Each light-impermeable portion 31 is located between two adjacent light-permeable portions 32. When a user is moving the shade body 3 upwards or downwards, a change in the areas of the light-impermeable portions 31 and the light-permeable portions 32 can be used to adjust the light input amount. Thus, the light input-adjustable window shade according to the present invention forms a rainbow curtain. Furthermore, although the rod body 41 in the above embodiments is received in the adjusting member 42, the rod body 41 of this embodiment can be located outside of the adjusting member 42. Thus, the relative position between the rod body 41 and the adjusting member 42 is not limited in the present invention.

In view of the foregoing, the light input-adjustable window shade according to the present invention utilizes a supporting unit 1 and a weighting unit 4. The two sliding rods 12 of the supporting unit 1 are slideably mounted to the two ends of the main rod 11, such that the length of the supporting unit 1 can be adjusted. Furthermore, the weighting unit 4 includes a length-adjustable rod body 41 and a length-adjustable adjusting member 42, such that the length of the weighting unit 4 can be adjusted. Thus, the light input-adjustable window shade according to the present invention can be installed with spools 2 and 2' and shade bodies 3 and 3' of different lengths without the need of replacing the supporting unit 1 and the weighting unit 4 while avoiding excessive length or insufficient length of the supporting unit 1 or the weighting unit 4 relative to the shade body 3, 3'. Accordingly, in the light input-adjustable window shade of each embodiment according to the present invention, it is not necessary to prepare molds for the supporting unit 1 and the weighting unit 4 for matching the spools 2 and 2' and the shade bodies 3 and 3' of different lengths. The production costs Of the light input-adjustable window shade are, thus, reduced.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A light input-adjustable window shade comprising:

a supporting unit including a main rod and two sliding rods, with the main rod having two ends, with the two sliding rods respectively slideably mounted to the two ends of the main rod, with each sliding rod having an end distant to the main rod, with a positioning seat fixed to the end of each of the two sliding rods, with each of the two sliding rods having a coupling portion, with each of the two sliding rods including a first channel having an opening facing the main rod, and with the first channels of the two sliding rods respectively receiving the two ends of the main rod, with the supporting unit further including a sleeve having two ends and a second channel extending through the two ends of the sleeve, with the sleeve mounted around the two sliding rods, and with the second channel slideably receiving the two sliding rods;

a spool rotatably mounted to the positioning seats of the supporting unit;

a shade body including a first periphery fixed to the spool and a second periphery, with the shade body coiled around the spool; and a weighting unit including a rod body, with the rod body comprised of an inner rod and two movable rods, with the inner rod having two ends, with each of the two movable rods slideably mounted to one of the two ends of the inner rod, with the shade body wound around the rod body, and with the second periphery of the shade body fixed to the coupling portions of the two sliding rods.

2. The light input-adjustable window shade as claimed in claim 1, with each positioning seat including a positioning section and a pivotal section, with the positioning section of each positioning seat coupled to the end of one of the two sliding rods distant to the main rod, and with the spool including two ends respectively and pivotably connected to the pivotal sections of the positioning seats.

3. The light input-adjustable window shade as claimed in claim 2, with the pivotal section of each positioning seat being a pivot, with each of the two ends of the spool including a receptacle, and with the receptacles of the spool pivotably engaged with the pivotal sections of the positioning seats.

4. The light input-adjustable window shade as claimed in claim 1, with the sleeve further including a slit intercommunicated with the second channel, with the slit overlapping with the coupling portions of the two sliding rods in an extending direction of the main rod.

5. The light input-adjustable window shade as claimed in claim 1, with the main rod further including a further channel extending through the two ends of the main rod, and with the two sliding rods respectively slideably extending through two ends of the further channel.

6. The light input-adjustable window shade as claimed in claim 5, with the main rod further including a slit intercommunicated with the further channel, with the slit overlapping with the coupling portions of the two sliding rods in an extending direction of the main rod.

7. The light input-adjustable window shade as claimed in claim 1, with each of the two movable rods of the rod body further including a third channel having an opening facing the inner rod of the rod body, and with the third channels of the two movable rods respectively receiving the two ends of the inner rod.

8. The light input-adjustable window shade as claimed in claim 1, with the shade body including a plurality of light-impermeable portions and a plurality of light-permeable portions, and with each of the plurality of light-impermeable portions located between two adjacent light-permeable portions of the plurality of light-impermeable portions.

9. A light input-adjustable window shade comprising:

a supporting unit including a main rod and two sliding rods, with the main rod having two ends, with the two sliding rods respectively slideably mounted to the two ends of the main rod, with each sliding rod having an end distant to the main rod, with a positioning seat fixed to the end of each of the two sliding rods, and with each of the two sliding rods having a coupling portion;

a spool rotatably mounted to the positioning seats of the supporting unit;

a shade body including a first periphery fixed to the spool and a second periphery, with the shade body coiled around the spool; and a weighting unit including a rod body, with the rod body comprised of an inner rod and two movable rods, with the inner rod having two ends, with each of the two movable rods slideably mounted to one of the two ends of the inner rod, with the shade body wound around the rod body, and with the second periphery of the shade body fixed to the coupling portions of the two sliding rods, with the weighting unit further including an adjusting member, with the adjusting member comprised of a main beam and two sliding beams, with the main beam having two ends, and with the two sliding beams respectively slideably received in the two ends of the main beam.

10. The light input-adjustable window shade as claimed in claim 9, with the main beam of the adjusting member further including a further channel extending through the two ends of the main beam, and with the two sliding beams of the adjusting member respectively and slideably extending through two ends of the further channel.

11. The light input-adjustable window shade as claimed in claim 10, with the rod body received in the adjustment member, with each of the two sliding beams of the adjusting member including two ends and another channel extending through the two ends of the sliding beam, with other channels of the two sliding beams intercommunicated with the further channel of the main beam, and with the rod body received in the further channel of the main beam and the other channels of the two sliding beams.

12. The light input-adjustable window shade as claimed in claim 11, with the main beam further including a first opening intercommunicated with the further channel, with the first opening extending through the two ends of the main beam, with each of the two sliding beams further including a second opening intercommunicated with the other channel thereof, with each second opening extending through the two ends of the one of the two sliding beams, and with the first opening of the main beam overlapping with the second openings of the two sliding beams in an extending direction of the main beam.

13. The light input-adjustable window shade as claimed in claim 12, with the second periphery of the shade body extending through the first opening of the main beam and the second openings of the two sliding beams of the adjusting member and extending into the further channel of the main beam and the other channels of the two sliding beams, with the shade body wound around the rod body and extending out of the weighting unit via the first opening of the main beam and the second openings of the two sliding beams, and with the second periphery of the shade body fixed to the coupling portions of the two sliding rods.

14. The light input-adjustable window shade as claimed in claim 9, with the weighting unit further including two fixing members respectively on two ends thereof, with each of the two fixing members including a first fixing portion and a second fixing portion, with two ends of the rod body respectively coupled to the first fixing portions of the two fixing members, and with two ends of the adjusting member coupled to the second fixing portions of the two fixing members.

15. The light input-adjustable window shade as claimed in claim 9, with each positioning seat including a positioning section and a pivotal section, with the positioning section of each positioning seat coupled to the end of one of the two sliding rods distant to the main rod, and with the spool including two ends respectively and pivotably connected to the pivotal sections of the positioning seats.

16. The light input-adjustable window shade as claimed in claim 9, with the main rod further including a further channel extending through the two ends of the main rod, and with the two sliding rods respectively slideably extending through two ends of the further channel.

17. The light input-adjustable window shade as claimed in claim 9, with each of the two movable rods of the rod body further including a third channel having an opening facing the inner rod of the rod body, and with the third channels of the two movable rods respectively receiving the two ends of the inner rod.

18. The light input-adjustable window shade as claimed in claim 9, with the shade body including a plurality of light-impermeable portions and a plurality of light-permeable portions, and with each of the plurality of light-impermeable portions located between two adjacent light-permeable portions of the plurality of light-impermeable portions.

* * * * *